US009349358B2

(12) United States Patent
Castres et al.

(10) Patent No.: US 9,349,358 B2
(45) **Date of Patent: *May 24, 2016**

(54) METHOD FOR SYNCHRONIZING AT LEAST ONE MULTIMEDIA PERIPHERAL OF A PORTABLE COMMUNICATION DEVICE WITH AN AUDIO FILE, AND CORRESPONDING PORTABLE COMMUNICATION DEVICE

(71) Applicant: DRNC Holdings, Inc., Wilmington, DE (US)

(72) Inventors: Christophe Castres, Parisis (FR); Minh Le, Neuilly sur Seine (FR); Michael Guilbaud, Toulouse (FR); Muriel Gohn, Chatou (FR)

(73) Assignee: DRNC Holdings, Inc., Wilmington, DE (US)

( * ) Notice: Subject to any disclaimer, the term of this patent is extended or adjusted under 35 U.S.C. 154(b) by 40 days.

This patent is subject to a terminal disclaimer.

(21) Appl. No.: 14/194,083

(22) Filed: Feb. 28, 2014

(65) Prior Publication Data

US 2014/0174281 A1 Jun. 26, 2014

Related U.S. Application Data

(63) Continuation of application No. 11/432,728, filed on May 11, 2006, now Pat. No. 8,664,505.

(30) Foreign Application Priority Data

May 12, 2005 (EP) ..... 05300374

(51) Int. Cl.

| | |
|---|---|
| ***G10H 7/00*** | (2006.01) |
| ***G10H 1/40*** | (2006.01) |
| ***G10H 1/00*** | (2006.01) |

(52) U.S. Cl.
CPC ..... *G10H 1/0066* (2013.01); *G10H 1/0008* (2013.01); *G10H 2230/021* (2013.01); *G10H 2240/325* (2013.01)

(58) Field of Classification Search
CPC ..... H04M 1/72558; G08B 7/06
USPC ..... 84/611, 645
See application file for complete search history.

(56) References Cited

U.S. PATENT DOCUMENTS

| | | | | |
|---|---|---|---|---|
| 2002/0025838 | A1* | 2/2002 | Kawamura | 455/567 |
| 2003/0114150 | A1* | 6/2003 | Hayashi | 455/418 |

(Continued)

FOREIGN PATENT DOCUMENTS

| | | |
|---|---|---|
| EP | 1172796 | 1/2002 |
| JP | 09191333 | 7/1997 |
| JP | 2001-320447 | 11/2001 |

OTHER PUBLICATIONS

"European Search Report", EP Application No. 05300374, Sep. 30, 2005, 2 pages.

(Continued)

*Primary Examiner* — Jeffrey Donels
(74) *Attorney, Agent, or Firm* — Theodore Naccarella

(57) ABSTRACT

A method for synchronizing a number R greater than or equal to 1 of multimedia peripherals (6) of a portable communication device with an audio file (1), comprising the steps of extracting a number P greater than or equal to 1 of basic synchronization signals ($SYNC_i$) according to a first sat of parameters (20); generating, from said P basic synchronization signals, a number Q greater than or equal to 1 of synchronization command signals ($COM_k$) according to a second set of parameters (30) defining rules to convert basic synchronization signals into signals adapted to the type of peripheral to be synchronized; and selecting, among said Q synchronization commend signals, R synchronization signals ($P_{SYNCk}$) for controlling R peripheral drivers (5) driving said R multimedia peripherals (40), according to a third set of parameters (40).

22 Claims, 3 Drawing Sheets

(56) References Cited

U.S. PATENT DOCUMENTS

| | | | | |
|---|---|---|---|---|
| 2003/0221544 | A1* | 12/2003 | Weissflog | 84/667 |
| 2005/0070241 | A1* | 3/2005 | Northcutt et al. | 455/265 |
| 2008/0019534 | A1* | 1/2008 | Reichelt et al. | 381/17 |
| 2008/0032676 | A1* | 2/2008 | Kraft et al. | 455/414.1 |

OTHER PUBLICATIONS

"United States Office Action", U.S. Appl. No. 11/432,728, Oct. 10, 2007, 10 pages.

"United States Office Action", U.S. Appl. No. 11/432,728, Apr. 10, 2012, 12 pages.

* cited by examiner

METHOD FOR SYNCHRONIZING AT LEAST ONE MULTIMEDIA PERIPHERAL OF A PORTABLE COMMUNICATION DEVICE WITH AN AUDIO FILE, AND CORRESPONDING PORTABLE COMMUNICATION DEVICE

RELATED APPLICATION

This application is related to and claims the benefit of priority from U.S. patent application Ser. No. 11/432,728, filed on May 11, 2006, now U.S. Pat. No. 8,664,505, which claims the benefit of European Patent Application No. 05 300 374.5, filed on May 12, 2005, the entirety of which is incorporated herein by reference.

FIELD OF THE INVENTION

The present invention relates to a method for synchronizing at least one multimedia peripheral of a portable communication device, such as a mobile phone, with an audio file.

BACKGROUND

The wording "multimedia peripherals" relates here to the different parts of the portable communication which can be activated in synchronization with music, for instance, in case of a mobile phone:

- the ringer for alerting a user in case reception of are incoming call or a message;
- vibrator means which might be used either instead of or combined with the ringing;
- the backlighting which is used for illuminating the display;
- the backlighting used for illuminating one or several keys on the keypad;
- Any dedicated illuminating devices such as leds which could be provided on the mobile phone.

Providing a portable communication device, such as a mobile phone, with means to synchronize one peripheral multimedia, as defined hereinabove by way of non-limitative examples, with an audio file, is already known. Audio files can be either synthetic or natural audio files.

Synthetic audio files relate to all kinds ref files which contain numeric data enabling a synthesizer to generate a music or melody, such as the standardized files known as MIDI (Acronym for Musical Instrument Digital Interface), SP-MIDI, or SMAF (Acronym for Synthetic music Mobile Application Format). More precisely, MIDI files do not contain any sound. They are in fact text files, containing encoded commands which enable a synthesizer to play notes. Numbers specify each note's position relative to the start of the music and its time-value, and its volume, including Crescendos and Diminuendos. Other commands set the instrument (e.g. 1=Grand Piano, 74=Flute) for each track/channel, the Tempo changes and the overall volume and stereo balance per track.

Generally, the synthetic files used for this particular application are specific as they contain a particular instrument which is to be used for synchronizing one peripheral multimedia, for instance instrument 125 in case of the ringing tone, or instrument 12 in case of the vibrator the ringer of the mobile phone. These specific synthetic files can be loaded in the memory of the mobile phone at the time of manufacturing. Alternatively, the user can download new synthetic files, either via the cellular network to which the mobile phone is affiliated, or via any type of networks including Internet, or from a PC. Once these files have been downloaded and stored in the memory of the mobile phone, the user has generally the possibility, via a specific menu, to choose the file which can be used for synchronizing each multimedia peripheral provided in its mobile phone.

Natural audio files are for instance MP3 or AAC (Advanced Audio Coding) files, for which decoding means, linked to loudspeakers, are needed for playing the files.

In the prior art solutions however, no solution enables a user to synchronize one or several multimedia peripherals of its mobile phone from an audio file, whatever the type (natural or synthetic) of audio file, and whatever the content of this audio file. Consequently, the choice for the user is generally limited to what manufacturers or networks operators or service providers propose, which does not always match with the users preferences.

In addition, peripherals to be synchronized are limited to a vibrator and a led, and synchronization signals generally correspond to a basic switch on or off of the peripheral in correspondence with the extracted synchronization parameters (proprietary audio file format only). This means that some audio files will not be adapted in some cases for activating a particular type of peripherals

OBJECTS AND SUMMARY

The aim of the invention is to remedy the above drawbacks by proposing a solution enabling to systematically synchronize at least a multimedia peripheral, whatever the type of peripheral with information coming from any type of audio file (natural or synthetic), whatever the content of this audio file, and especially even in case in which no synchronization information is contained in this audio file.

To this aim, an object of the present invention is to provide a method for synchronizing, with an audio fire, a number R greater than or equal to 1 of multimedia peripherals of a portable communication device, comprising the following steps:

- Extracting from said audio file a number P greater than or equal to 1 of basic synchronization signals according to a first set of parameters;
- Generating, from said P basic synchronization signals, a number Q greater than or equal to 1 of synchronization command signals according to a second set of parameters defining rules to convert basic synchronization signals into signals adapted to the type of peripheral to be synchronized;
- Selecting, among said Q synchronization command signals, R synchronization signals for controlling R peripheral drivers driving said R multimedia peripherals, according to a third set of parameters.

Consequently, it becomes possible to create different customizable synchronizations based on any type of audio sources and depending on the peripheral that is addressed.

According to one possible embodiment of the invention, said audio file is a synthetic audio file, and said first set of parameters comprises at least the number P of said basic synchronization signals and a specific instrument used for synchronization purpose.

Alternatively, said audio file is a synthetic audio file, an that said first set of parameters comprises at least the number P of said basic synchronization signals and a list of preferred instruments.

In this case, said first set of parameters may additionally comprise a priority information for each of said preferred instrument.

Additionally or in combination, said first set of parameters may comprise a frequency threshold and/or a duration threshold and/or a transition threshold between successive notes.

According to another possible embodiment of the invention, said audio file is a natural audio file, said step of extracting comprises a step of computation of a variable representative of the rhythm in said audio file, and said first set of parameters comprises at least the number P of said basic synchronization signals and several predetermined thresholds for comparison with said variable.

In such case, said variable may be a frequency band energy information or an average of the signal power.

Advantageously, said second set of parameters is chosen among the following parameters:

- a frequency division parameter to be applied to a basic synchronization signal in order to generate a synchronization command signal; and/or
- A parameter representing the number of successive impulses inside a basic synchronization signal before the beginning of the generation of a synchronization command signal; and/or A parameter representing the number of successive impulses contained in a synchronization command signal.

Advantageously, said sets of parameters can be determined at the time of manufacturing, by memorizing it in the portable communication device, and/or selected by the user via a specific menu.

A second object of the present invention is a portable communication device comprising a number R greater than or equal to 1 of multimedia peripherals, each of which can be activated with synchronism with an audio file, characterized in that it comprises:

- A synchronization extractor for extracting, from said audio file, a number P greater than or equal to 1 of basic synchronization signals according to a first set of parameters;
- A synchronization manager for generating, from said P basic synchronization signals, a number Q greater than or equal to 1 of synchronization command signals according to a second set of parameters defining rules to convert basic synchronization signals into signals adapted to the type of peripheral to be synchronized;
- A mapping manager for selecting, among said Q synchronization command signals, R synchronization signals for controlling R peripheral drivers driving said R multimedia peripherals, according to a third s of parameters.

BRIEF DESCRIPTION OF THE DRAWINGS

Other features and advantages of the invention will become apparent from the following description of embodiments of the invention given by way of non-limiting examples only, and with reference to the accompanying drawings, in which.

DETAILED DESCRIPTION

Figure 1:
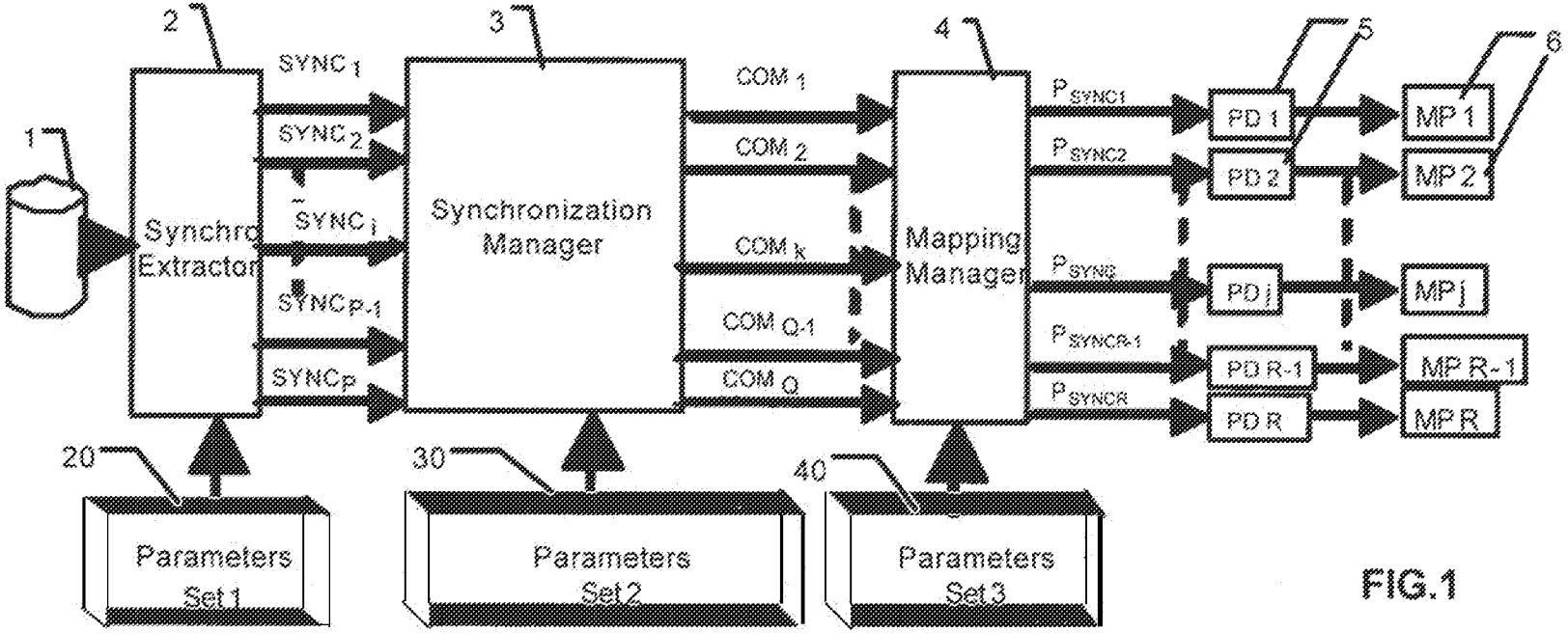
FIG. 1 shows schematically some parts of a portable communication device according to the invention.

In relation with FIG. 1, a portable communication device, such as a mobile phone, is provided with a number R greater or equal to 1 of multimedia peripherals 6 controlled by R corresponding peripherals drivers 5, according to R synchronization signals $P_{SYNCj}$(for j=[1 . . . R]).

According to the invention, means are provided in the portable device in order to generate these R synchronization signals $P_{SYNCj}$(for j=[1 . . . R]) starting from any synthetic or natural audio file 1 stored in said portable device. For this purpose, the portable communication device essentially comprises three parts 2, 3, and 4 and three sets of pre stored parameters 20, 30, 40.

More precisely, in a first step of the method according to the invention, a synchronization extractor 2 receives as input said audio file 1, and delivers a number P greater than or equal to 1 of basic synchronization signals $SYNC_i$ (for i=[1 . . . P]). These P basic synchronization are extracted from audio file 1 depending on a first set of parameters 20. This first set of parameters 20 is used to define the kind of information which should be extracted from audio file 1.

For instance, if audio file 1 is a MIDI file, one possible parameter could be a specific instrument of the file usually used for synchronization purpose (namely instrument N° 125). Alternatively or in combination, said first set of parameters could also comprise any existing instrument which can be found in audio file 1, according to a list of preferred instruments. In case several instruments of the preferred list can be found in the audio file, selection of one or several instruments can be specifically chosen depending on other parameters of first set 20 such as:

- the number P of signals which must be extracted; and/or
- priority information for each instrument of the list. For instance, if two instruments of the preferred list are found in audio file 1, preference will be given to instrument with the highest priority information; and/or
- a predetermined frequency threshold, in this case, the frequency apparition of notes for each instrument in said audio files are compared with the frequency threshold, and instruments are chosen depending on the result of comparison; and/or
- a duration threshold. In this case, analysis of the duration of notes performed for each instrument of the audio file, and only instruments for which the greatest number of notes which duration is superior to the duration threshold has been found are selected; and/or
- a transition threshold between two successive notes. In this case, analysis of transition between two successive notes for each instrument of the audio file is performed, and for instance, only instruments for which transitions are greater than the threshold are selected.

In case audio file 1 is a natural audio file, synchronization extractor 2 will make a computation of a variable representative of the rhythm, such as frequency band energy information, or an average of the signal power. One or several pre determined thresholds will then be used for comparison with said variable, in order to deliver one or several corresponding basic synchronization signals depending on the comparison result(s). Consequently, in case of a natural audio file, first set of parameters 20 will essentiality comprise the number R of signals which must be extracted and the above-mentioned threshold(s).

As can be noticed, this gives to a user a great choice of selection for customization purpose since any type of audio file, whatever the format, and even if this audio file does not contain any dedicated synchronization information, can be used.

Set of parameters 20 can be determined at the time of manufacturing, by memorizing it in the portable communication device. Alternatively or additionally, access to a specific menu can be authorized in order that a user may, at any time, configure a set of parameters of his own choice.

Coming back again to FIG. 1, each basic synchronization signal $SYNC_i$ (for i=[1 . . . P]) output by synchronization extractor 2 is delivered on the inputs of a synchronization manager 3. The aim of synchronization manager 3 is to generate, starting from said P basic synchronization signals $SYNC_i$ (for i=[1 . . . P]), a number Q greater than or equal to 1 of synchronization command signals $COM_k$ (for k={1 . . . Q}). These Q synchronization command signals are generated depending on a second set of parameters 30. This second set of parameters 30 is used to define rules to convert basic synchronization signals into signals adapted to the type of peripheral to be activated.

In a possible non limitative embodiment, set of parameters 30 comprises:

- a frequency division parameter Div(k)=m, with m being an integer between 1 to n. This parameter enables to select, in a basic synchronization signal $SYNC_i$, only one impulse among m successive impulses; and/or
- A parameter Nbimp1(k) (for k=[1 . . . Q]) which represents the number of successive impulses inside a basic synchronization signal before the beginning of the generation of a synchronization command signet $COM_k$; and/or
- A parameter Nbimp2(k) (for k=[1 . . . Q]) which represents the number of successive impulses contained in a synchronization command signal $COM_k$ Set of parameters 30 can also be determined at the time of manufacturing, by memorizing it in the portable communication device. Alternatively or additionally, access to a specific menu can be authorized in order that a user may, at any time, configure the set of parameters.

Finally, each synchronization command signal $COM_k$ (for k=[1 . . . Q]) output by synchronization manager 3 is delivered on the inputs of a mapping manager 4. The aim of mapping manager 4 is to establish a correspondence between delivered synchronization commend signals $COM_k$ (for k=[1 . . . Q]) and peripherals 5, depending on a third set of parameters 40 which gives the mapping table. Here again, set of parameters 40 can be determined at the time of manufacturing, by memorizing it in the portable communication device. Alternatively or additionally, access to a specific menu can be authorized in order that a user may, at any time, configure the set of parameters.

Figure 2:
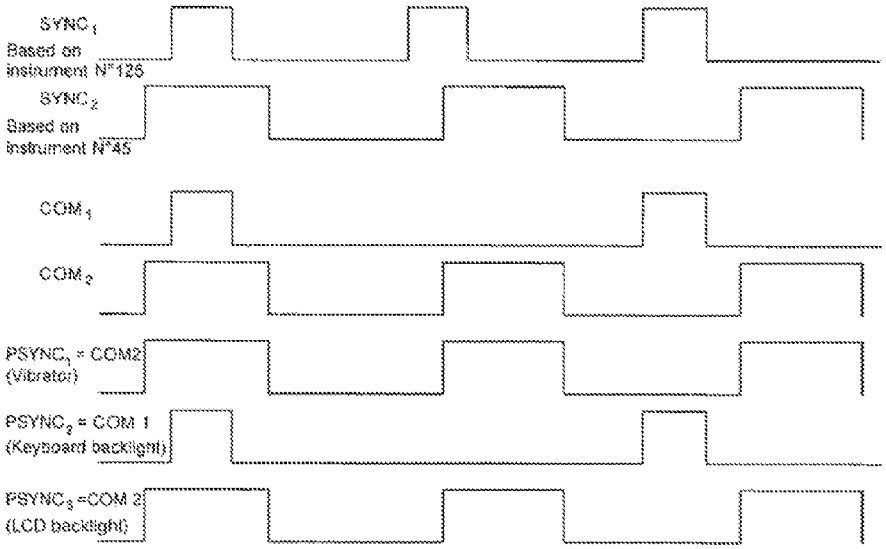
FIG. 2 shows a first example concerning the generation of three synchronization signals from two basic synchronization signals extracted from a MIDI file, for synchronization of a vibrator, a keyboard backlight and a LCD backlight.
Figure 3:
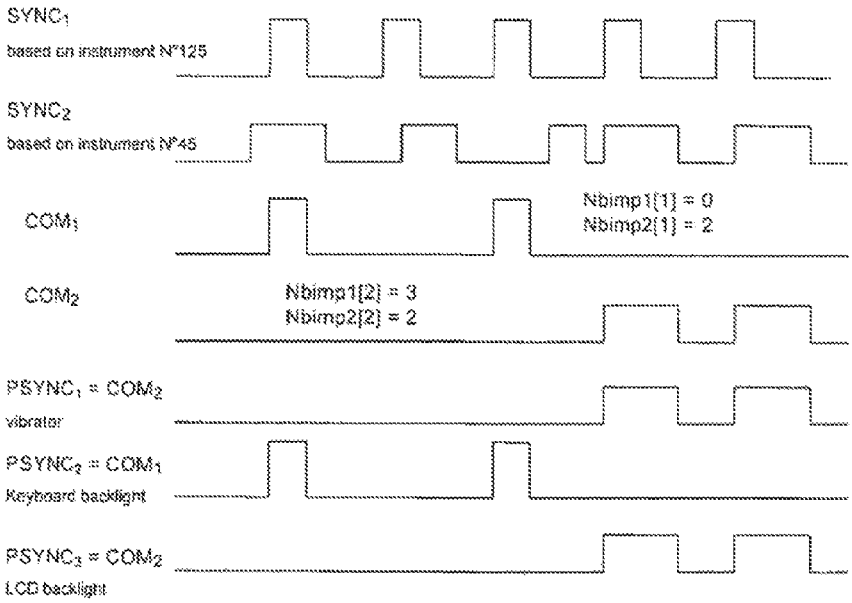
FIG. 3 shows a second example concerning the generation of three synchronization signals from two basic synchronization signals extracted from a MIDI file for synchronization of a vibrator, a keyboard backlight and a LCD backlight.
Figure 4:
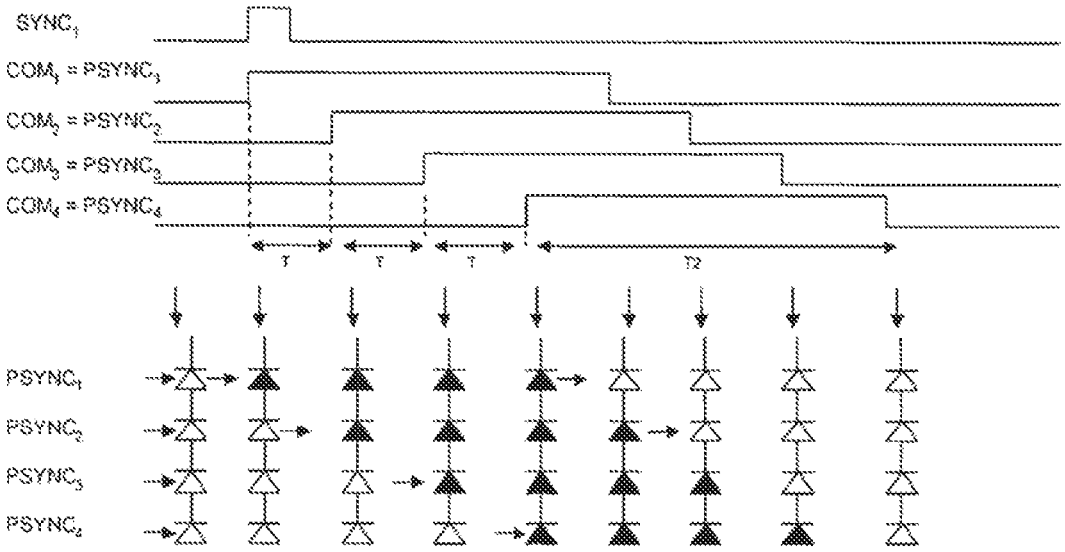
FIG. 4 shows a third example concerning the generation of three synchronization signals from one basic synchronization signal extracted from an audio file, for synchronization of four leds.

FIGS. 2 to 4 give several examples of synchronization generation according to the general principles just explained above:

In the case of FIG. 1, it is assumed that R=3 peripherals are to be synchronized from a synthetic audio, namely:

MP 1=a vibrator;

MP 2=a keyboard backlight; and

MP 3=A LCD backlight.

with the corresponding R=3 synchronization signal $P_{SYNC1}$, $P_{SYNC2}$ and $P_{SYNC3}$.

First set of parameters 20, enabling extract basic synchronization signals, comprises here the following parameters:

P=2 signals to be output by synchronization extractor 2.

Instruments N° 125 and N° 45 to be extracted from the audio file.

Synchronization manager 3 thus delivers signal $SYNC_1$ and $SYNC_2$.

Second set of parameters 30, enabling to generate Q synchronization command signals, comprises here the following parameters:

Q=2 signals to be output by synchronization manager 3.

Div(1)=2; Nbimp1(1)=0 and Nbimp2(1)=2. This leads to generate a synchronization command signal $COM_1$ which has only two impulsions corresponding to the first and third impulsions of $SYNC_1$.

Div(2)=1; Nbimp1(2)=0 and Nbimp2(3)=3. This leads to generate a synchronization command signal $COM_2$ which has only three impulsions corresponding to the three first impulsions of $SYNC_2$.

At last, third set of parameters 40 gives the following correspondence between peripherals and synchronization signals:

Vibrator must be synchronized with COM2, which means that $P_{SYNC1}=COM_2$;

Keyboard backlight must be synchronized with COM1, which means that $P_{SYNC2}=COM_1$; and LCD backlight must be synchronized with COM2, which means that $P_{SYNC3}=COM_2$ The example of FIG. 3 is quite similar to the example of FIG. 2 since first and third sets of parameters remain the same. However, signals $SYNC_1$ and $SYNC_2$ which are extracted from the audio file have a different shape with comparison to FIG. 2. In addition, second set of parameters 20 comprises here the following parameter:

Q=2 signals to be output by synchronization manager 3.

Div(1)=2; Nbimp1(1)=0 and Nbimp2(1)=2. This leads to generate a synchronization command signal $COM_1$ which has only two impulsions corresponding to the first and third impulsions of $SYNC_1$.

Div(2)=1; Nbimp1(2)=3 and Nbimp2(3)=2. This leads to generate a synchronization command signal $COM_2$ which has only three impulsions corresponding to the three last impulsions of $SYNC_2$ shown on the figure.

FIG. 4 gives a third example wherein four leds are activated in a particular way with synchronism with only one basic synchronization signal $SYNC_1$ extracted from an audio file. In the given example, only one impulse of signal $SYNC_1$ will be converted by Synchronization manager 3 in four signals $COM_1$ to $COM_4$ which will each drive one led in order to have a complex visual effect. On the figure, a black colored led indicates when a led is lighted on. The duration T between the beginning of each signal $COM_k$ and the duration T2 of each impulse of $COM_k$ are parameters set in the second set of parameters 30 used by synchronization manager 3.

It will be understood that synchronization extractor 2, synchronization manager 3 and mapping manager are controlled by the portable communication device's software.

Thanks to the method according to the invention, several multimedia peripherals of a portable communication device can be easily synchronized in a more featured way, without any limitation concerning the audio file sources.

The invention claimed is:

1. A method for synchronizing at least one peripheral device of a portable communications device with an audio file, the method comprising:

extracting from the audio file one or more basic synchronization signals according to one or more first parameters that define one or more kinds of information to be extracted from the audio file;

generating, from the one or more basic synchronization signals, one or more synchronization command signals adapted to types of multimedia peripherals to be synchronized according to one or more second parameters that define rules for converting the one or more basic synchronization signals into the one or more synchronization command signals; and assigning the one or more synchronization command signals to control one or more multimedia peripheral device drivers driving the one or more multimedia peripheral devices.

2. The method of claim 1 wherein the portable communications device is a mobile telephone.

3. The method of claim 1 wherein the one or more first parameters comprises a kind of musical instrument parameter.

4. The method of claim 1 wherein the one or more first parameters comprise a plurality of parameters including at least one of (1) a frequency threshold parameter indicating a frequency of appearance of notes in the audio file corresponding to a kind of musical instrument that is required to use information for that kind of instrument for generating a one of the basic synchronization signals, (2) a duration threshold parameter indicating a duration of notes in the audio file corresponding to a kind of musical instrument that is required to use information for that kind of instrument for generating a one of the basic synchronization signals, and (3) a transition threshold parameter indicating a transition between two notes in the audio file corresponding to a kind of musical instrument that is required in order to use information for that kind of instrument for generating a one of the basic synchronization signals.

5. The method of claim 3 wherein the one or more first parameters comprise a plurality of kinds of instrument parameters.

6. The method of claim 5 wherein the first parameter comprises a plurality of parameters further including at least one of (1) a frequency threshold parameter indicating a frequency of appearance of notes in the audio file corresponding to a kind of musical instrument that is required to use information for that kind of instrument for generating a one of the basic synchronization signals, (2) a duration threshold parameter indicating a duration of notes in the audio file corresponding to a kind of musical instrument that is required to use information for that kind of instrument for generating a one of the basic synchronization signals, and (3) a transition threshold parameter indicating a transition between two notes in the audio file corresponding to a kind of musical instrument that is required in order to use information for that kind of instrument for generating a one of the basic synchronization signals.

7. The method of claim 1 wherein the one or more first parameters comprises at least one of a frequency band energy parameter and an average signal power parameter.

8. The method of claim 7 wherein the one or more first parameters further comprises a frequency band energy threshold parameter indicating an amount of frequency band energy that is required to use the frequency band energy parameter for generating a one of the basic synchronization signals.

9. The method of claim 7 wherein the one or more first parameters further comprises an average signal power threshold parameter indicating an average signal power threshold that is required to use the average signal power parameter for generating a one of the basic synchronization signals.

10. The method of claim 1 wherein the one or more second parameters comprises at least one of (1) a frequency division parameter indicating a frequency of impulses in the one or more basic synchronization signals to be used in generating the one or more synchronization command signals, (2) a beginning events parameter indicating a number of successive impulses in the one or more basic synchronization signals before the beginning of the generation of the one or more synchronization command signals, and (3) a successive events parameter indicating a number of successive impulses in the one or more basic synchronization signals contained in the one or more synchronization command signals.

11. The method of claim 1 wherein the assigning comprises mapping each of the one or more synchronization command signals to one or more of the multimedia peripheral device drivers according to one or more third parameters.

12. A portable communication device operable to play an audio file comprising:

one or more multimedia peripheral devices;

one or more multimedia peripheral device drivers for driving the multimedia peripheral devices:

a synchronization extractor that extracts, from the audio file, one or more basic synchronization signals according to one or more first parameters that define one or more kinds of information to be extracted from the audio file;

a synchronization manager for generating, from the one or more basic synchronization signals, one or more synchronization command signals adapted to types of multimedia peripherals to be synchronized according to one or more second parameters that define rules for converting the one or more basic synchronization signals into the one or more synchronization command signals; and a mapping manager for assigning the one or more synchronization command signals to control the one or more multimedia peripheral device drivers.

13. The device of claim 12 wherein the device is a mobile telephone.

14. The device of claim 12 wherein the one or more first parameters comprises a kind of musical instrument parameter.

15. The device of claim 14 wherein the first parameter comprises a plurality of parameters including at least one of (1) a frequency threshold parameter indicating a frequency of appearance of notes in the audio file corresponding to a kind of musical instrument that is required to use information for that kind of instrument for generating a one of the basic synchronization signals, (2) a duration threshold parameter indicating a duration of notes in the audio file corresponding to a kind of musical instrument that is required to use information for that kind of instrument for generating a one of the basic synchronization signals, and (3) a transition threshold parameter indicating a transition between two notes in the audio file corresponding to a kind of musical instrument that is required in order to use information for that kind of instrument for generating a one of the basic synchronization signals.

16. The device of claim 14 wherein the one or more first parameters comprise a plurality of kinds of instrument parameters.

17. The device of claim 16 wherein the one or more first parameters comprise a plurality of parameters further including at least one of (1) a frequency threshold parameter indicating a frequency of appearance of notes in the audio file corresponding to a kind of musical instrument that is required to use information for that kind of instrument for generating a one of the basic synchronization signals, (2) a duration threshold parameter indicating a duration of notes in the audio file corresponding to a kind of musical instrument that is required to use information for that kind of instrument for generating a one of the basic synchronization signals, and (3) a transition threshold parameter indicating a transition between two notes in the audio file corresponding to a kind of musical instrument that is required in order to use information for that kind of instrument for generating a one of the basic synchronization signals.

18. The device of claim 12 wherein the one or more first parameters comprises at least one of a frequency band energy parameter and an average signal power parameter.

19. The device of claim 18 wherein the one or more first parameters further comprises a frequency band energy threshold parameter indicating an amount of frequency band energy that is required to use the frequency band energy parameter for generating a one of the basic synchronization signals.

20. The device of claim 18 wherein the one or more first parameters further comprises an average signal power threshold parameter indicating an average signal power threshold that is required to use the average signal power parameter for generating a one of the basic synchronization signals.

21. The device of claim 12 wherein the one or more second parameters comprises at least one of (1) a frequency division parameter indicating a frequency of impulses in the one or more basic synchronization signals to be used in generating the one or more synchronization command signals, (2) a beginning events parameter indicating a number of successive impulses in the one or more basic synchronization signals before the beginning of the generation of the one or more synchronization command signals, and (3) a successive events parameter indicating a number of successive impulses in the one or more basic synchronization signals contained in the one or more synchronization command signals.

22. The device of claim 12 wherein the assigning comprises mapping each of the one or more synchronization command signals to one or more of the multimedia peripheral device drivers according to one or more third parameters.

* * * * *